United States Patent [19]

Nilmen et al.

[11] Patent Number: 4,744,947

[45] Date of Patent: May 17, 1988

[54] METHOD OF DISPERSION-HARDENING OF COPPER, SILVER OR GOLD AND OF THEIR ALLOYS

[75] Inventors: Fehmi Nilmen, Kriftel; Heinrich Winter, Eschborn, both of Fed. Rep. of Germany

[73] Assignee: Battelle-Institut e.V., Frankfurt am Main, Fed. Rep. of Germany

[21] Appl. No.: 6,711

[22] PCT Filed: Apr. 18, 1986

[86] PCT No.: PCT/EP86/00231

§ 371 Date: Jan. 28, 1987

§ 102(e) Date: Jan. 28, 1987

[87] PCT Pub. No.: WO86/07613

PCT Pub. Date: Dec. 31, 1986

[51] Int. Cl.[4] ..... C22C 9/00

[52] U.S. Cl. ..... 420/590; 148/430; 148/432

[58] Field of Search ..... 420/590, 501–512, 420/492, 469; 148/432–436, 430

[56] References Cited

U.S. PATENT DOCUMENTS

| | | | |
|---|---|---|---|
| 3,194,656 | 7/1965 | Vordahl . | |
| 3,993,478 | 11/1976 | Hay et al. | 75/159 |
| 4,419,130 | 12/1983 | Slaughter | 75/244 |
| 4,540,546 | 9/1985 | Giessen | 420/590 |

OTHER PUBLICATIONS

Snow et al. "Rapid Solidification Processing of Superalloys Using High Powered Laser" Rapid Solidification Source Book Asu 1983 pp. 138–152.

Chemical Abstracts, Band 76, No. 8, 21 (1972).

*Primary Examiner*—Christopher W. Brody

*Attorney, Agent, or Firm*—Fisher, Christen & Sabol

[57] ABSTRACT

According to a method of dispersion hardening copper, silver or gold, melts on the basis of the matrix metals with stoichiometric additions of boron and boride-forming metals are superheated by 300° to 750° C. and subsequently subjected to extremely rapid solidification at a rate of at least $10^3$ to $10^4$ °C. per second. The boride-forming metals used are preferably titanium and/or zirconium. An excess of preferably about 5 to 20% of boride-forming metal over the stoichiometric amount yields particularly favorable products.

15 Claims, No Drawings

METHOD OF DISPERSION-HARDENING OF COPPER, SILVER OR GOLD AND OF THEIR ALLOYS

DESCRIPTION

The invention relates to a method of dispersion-hardening of copper, silver or gold, as well as of their alloys, as matrix metal with metal borides as dispersoid. In addition, the invention relates to the application of this method to the production of any spot welding electrodes, in particular for welding galvanized sheets.

The known methods of dispersion-hardening of copper, silver or gold either start from extremely fine and thus very expensive powders of the matrix metal which is thoroughly mixed with the dispersoid, mostly aluminum oxide or beryllium oxide particles, and subsequently compacted and extruded; or alloys of the matrix metal containing small proportions of easily oxidizable metals such as beryllium or aluminum are processed into powders which are subjected to internal oxidation in a second, expensive and complicated step which, upon appropriate control of the process leads to the desired fine distribution of oxide particles of less than 0.1 μm diameter in a matrix. The method of internal oxidation has the disadvantage that the oxidation is accompanied by external oxidation of copper. This requires final reduction annealing with hydrogen, which in turn leads to undesirable caking of the powders and thus to impaired handling properties, in particular in the production of shaped parts.

Both methods are expensive and complicated and therefore have found only limited acceptance. Simultaneous precipitation of matrix metal and dispersoid from respective metallic salt solutions, as well, is too expensive for application on an industrial scale. In addition, all metals dispersion-hardened with oxides of this type, such as copper or silver, show strong hot embrittlement of about 500° C. The high ductility at room temperature, which is indicated by an ultimate elongation of about 20%, decreases very strongly with increasing temperature to reach a minimum as low as about 2% at about 500° C. This represents a serious disadvantage of these dispersion-hardened alloys.

The object of the invention is to provide a simple and economical method of producing dispersion-hardened alloys on the basis of copper, silver or gold which contain dispersoids that keep hot embrittlement at a minimum.

According to the invention, this object is reached by the fact that melts on the basis of the matrix metals with stoichiometric additions of boron and boride-forming metals are superheated by 300° to 750° C. and subsequently subjected to extremely rapid solidification at a rate of at least $10^{3°}$ to $10^{4°}$ C. per second. Advantegeous embodiments of the method according to the invention are described in claims 2 to 9. Claim 10 relates to the application of the method to the production of spot welding electrodes, in particular for welding galvanized sheets.

Suitable dispersoids are borides of the elements of the groups IV A, V A and VI A of the periodic system, either singly or in combination. Preferably, however, high-melting-point titanium or zirconium boride is formed, together with the mixed boride of titanium and zirconium of the composition $Ti_xZr_{1-x}B_2$. These borides are found to be soluble in the melt to an extent that is sufficient for dispersion hardening, at temperatures of the melt above about 1500° C., and to precipitate in the matrix after extremely rapid solidification, e.g. by atomization, as dispersoid of a particle size below 0.1 μm. It is thus possible to produce dispersion-hardened alloys economically in one step direct from the melt.

To produce dispersion-hardened alloys on the basis of copper, silver or gold according to the invention, their melts are carefully deoxidized and then stoichiometric proportions of boron, titanium and/or zirconium in the form of master alloys are added to form 1 to 5 volume percent of the diboride. The melts are superheated by 300° to 750° C. and subsequently processed into powder at solidification rates of more than $10^3$ to $10^{4°}$ C. per second, e.g. by atomization. Superheating of the melt means that a temperature of 300° to 750° C. above melting temperature is selected. After compacting and extruding, a dispersion-hardened semifinished product is then obtained in an economical way.

The submicron-sized boride particles incorporated in the metal matrix according to the invention do not coarsen even after annealing for several hours at temperatures up to 850° C. This indicates that the solubility of these boride particles in the metal matrix must be very low. This is a basic condition for efficient dispersion hardening and high electric conductivity.

A dispersion-hardened alloy on the basis of copper containing 3 volume percent of a $Ti_{0.7}Zr_{0.3}B_2$ dispersoid produced by atomizing the melt was found to show an electric conductivity of 90% of pure copper, and at 800° C. a hot tensile strength of 17 kg/mm$^2$ at an ultimate elongation of 25%. The alloy thus does not show hot embrittlement.

According to the invention, the extremely rapid solidification at rates exceeding $10^{3°}$ to $10^{4°}$ C. per second can be achieved by melt spinning. This permits direct production of dispersion-hardened ribbons which can be cold formed by rolling.

According to an additional embodiment of the invention, the matrix metals or alloys containing boron or boride-forming metals in proportions according to the invention, are applied onto surfaces in the form of powders and locally fused by a laser or electron beam. Rapid solidification is effected by transfer of the heat into the interior of the substrate.

It has been found that the use of an excess of boride-forming metals of 3 to 30, preferably of 5 to 20%, above the stoichiometric amount results in precipitation hardening in addition to dispersion hardening. In the case of titanium, for example, this means that 1.1 weight percent of titanium is used instead of an addition of 1 weight percent of titanium, for example, which corresponds to an excess of 10%. The materials produced according to the invention are suitable in particular for electric conductors which are subject to mechanical loads at high temperatures, as for spot welding electrodes, commutator segments and contacts. In addition, they show excellent thermal conductivity and a wear resistance which strongly increases with increasing boride volume concentration.

We claim:

1. Method for the dispersion hardening of copper, silver or gold as well as the alloys thereof as the matrix metal with at least one metal boride as the dispersoid, comprising: preparing a single melt of the matrix metal, adding stoichiometric amounts of boron and at least one boride forming metal to said melt, superheating the resultant melt by about 300°to 750° C. above the melting temperature of the matrix metal and subsequently subjecting said melt to extremely rapid solidification at a rate of at least 103° C. to 104° C. per second.

2. Method as claimed in claim 1 wherein boron and said at least one boride-forming metal are added in the form of master alloys.

3. Method as claimed in claim 1 or claim 2 wherein at least one element from at least one of the groups IV A, V A and VI A of the periodic system is used as said at least one boride-forming metal, either singly or in combination.

4. Method as claimed in claim 3 wherein boron and said at least one boride-forming metal are used in amounts to form 1 to 5 volume percent of metal boride.

5. Method as claimed in claim 4 wherein boron, titanium and zirconium are used in amounts to form a mixed boride of the composition $Ti_xZr_{1-x}B_2$.

6. Method as claimed in claim 5 wherein rapid solidification is achieved by atomization of the melt using a gaseous or liquid medium or by melt spinning.

7. Method as claimed in claim 5 wherein an excess concentration over the stoichiometric composition of 3 to 30 percent of said at least one boride-forming metal is used.

8. Method as claimed in claim 1 wherein boron and said at least one boride-forming metal are used in amounts to form 1 to 5 volume percent of metal boride.

9. Method as claimed in claim 1 wherein boron, titanium and zirconium are used in amounts to form a mixed boride of the composition $Ti_xZr_{1-x}B_2$.

10. Method as claimed in claim 1 wherein rapid solidification is achieved by atomization of the melt using a gaseous or liquid medium or by melt spinning.

11. Method as claimed in claim 1 wherein an excess concentration over the stoichiometric composition of 3 to 30 percent of said at least one boride-forming metal is used.

12. Method as claimed in claim 1 wherein an excess concentration over the stoichiometric composition of 5 to 20 percent of said at least one boride-forming metal is used.

13. Method as claimed in claim 3 wherein said at least one element is titanium or zirconium or both.

14. Method as claimed in claim 5 wherein said composition $Ti_xZr_{1-x}B_2$ is $Ti_{0.7}Zr_{0.3}B_2$.

15. Method as claimed in claim 9 wherein said composition $Ti_xZr_{1-x}B_2$ is $Ti_{0.7}Zr_{0.3}B_2$.

* * * * *